US007134481B2

(12) United States Patent
Osada et al.

(10) Patent No.: US 7,134,481 B2
(45) Date of Patent: Nov. 14, 2006

(54) PREHEATING MEMBER CHANGER OF DUAL ROLL CASTING APPARATUS

(75) Inventors: Shiro Osada, Tokyo (JP); Osamu Takeuchi, Tokyo (JP); Shu Ogawa, Tokyo (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 10/550,412

(22) PCT Filed: Nov. 11, 2003

(86) PCT No.: PCT/JP03/14300

§ 371 (c)(1),
(2), (4) Date: Sep. 23, 2005

(87) PCT Pub. No.: WO2005/044486

PCT Pub. Date: May 19, 2005

(65) Prior Publication Data

US 2006/0196628 A1 Sep. 7, 2006

(51) Int. Cl.
*B22D 11/06* (2006.01)

(52) U.S. Cl. ..... 164/428; 164/480

(58) Field of Classification Search ..... 164/428–429, 164/479–480
See application file for complete search history.

(56) References Cited

U.S. PATENT DOCUMENTS

2003/0111203 A1* 6/2003 Mertins ..... 164/34

FOREIGN PATENT DOCUMENTS

| | | |
|---|---|---|
| JP | 61-176447 | 8/1986 |
| JP | 5-115962 | 5/1993 |
| JP | 6-339751 | 12/1994 |
| JP | 6-339753 | 12/1994 |

* cited by examiner

*Primary Examiner*—Kuang Y. Lin
(74) *Attorney, Agent, or Firm*—Oblon, Spivak, McClelland, Maier & Neustadt, P.C.

(57) ABSTRACT

A casting roll unit (U) with side weirs (6) and a delivery nozzle (8) being detachably attached thereto is fixed at a casting position. Side-weir and delivery-nozzle preheating furnaces (29, 30) are arranged away from the casting roll unit (U). Arranged adjacent to the roll unit (U) are replacing robots (31, 32) which can selectively clamp the side weirs (6) or the delivery nozzle or nozzles (8) and which can move between the roll unit (U) and the side-weir or delivery-nozzle preheating furnace (29 or 30) for installation/removal of the side weirs (6) or delivery nozzle or nozzles (8).

10 Claims, 12 Drawing Sheets

PREHEATING MEMBER CHANGER OF DUAL ROLL CASTING APPARATUS

TECHNICAL FIELD

This invention relates to an apparatus for displacing preheated members for a twin-roll caster and more specifically to an apparatus for displacing preheated members for a twin-roll caster that is simple in structure and that can promptly install preheated side weirs and delivery nozzle or nozzles on a casting roll unit.

BACKGROUND ART

Side weirs, a delivery nozzle or nozzles, a tundish and the like installed on a casting roll unit in a twin-roll caster are members in direct contact with molten metal so that they need to be preheated before start of casting.

Thus, JP 06-339753 A discloses techniques for preheating side weirs, a delivery nozzle and a tundish to be installed on a casting roll unit before start of casting.

A twin-roll caster in JP 06-339753 A will be outlined with reference to FIGS. 1–4. This device comprises, as shown in FIG. 2, a casting roll unit U having two water-cooled, contra-rotatable parallel casting rolls 1 which are supported by a carriage frame 3 of a casting roll carriage 2. The casting roll carriage 2, which supports the casting roll unit U, is adapted to be displaced between an assembly station B and an actual casting station A in a lateral direction perpendicular to a widthwise direction of the roll unit U or to a lengthwise direction of the casting rolls 1.

Side-weir mounting/dismounting devices 4 shown in FIG. 4 are arranged widthwise outward of the casting roll unit U when the roll unit is at the casting station A. Each of the side-weir mounting/dismounting devices 4 comprises a hydraulic cylinder unit 5*a* and a plate holder 5*b* movable in the above-mentioned widthwise direction by actuating the hydraulic cylinder unit 5*a*. Side weirs 6 are mounted on the plate holders 5*b* and urged by the expanded cylinder units 5*a* into engagement with opposite stepped ends 7 of the casting rolls 1 to thereby close the opposite ends of the casting rolls 1.

A tapered delivery nozzle 8 is arranged above and between the casting rolls 1, and is long in the widthwise direction to provide an inwardly and downwardly converged bottom as shown in FIG. 3 to fit into a mounting bracket 9 on the carriage frame 3 of the roll carriage 2, thereby entering into a nip between the parallel casting rolls 1.

Furthermore, a tundish 10 is positioned via its mounting bracket 11 on the carriage frame 3 of the roll carriage 2.

A ladle 12 (FIG. 1) is adapted to be positioned above the casting roll unit U at the casting station A and to supply molten metal via the tundish 10 and delivery nozzle 8 during casting. Thus, furnaces to preheat the side weirs 6, delivery nozzle 8 and tundish 10 and robot devices to displace them are arranged at positions not interfering with the ladle 12.

More specifically, electric resistance heater furnaces 13 are arranged above the cylinder units 5*a* for movement of the plate holders 5*b* of the side-weir mounting/dismounting devices 4 at the casting station A in FIG. 4. Side-weir robot devices 14 are arranged above and between the heater furnaces 13 and widthwise ends of the roll units U, respectively. Each of the robot devices 14 comprises, as shown in FIGS. 2 and 4, a telescopic unit 18 fixed to an upper member of a main machine frame 15 and vertically expanded or contracted by cylinder units 16 and 17, a rotary head 19 on a lower end of the telescopic unit 18 and horizontally rotatable over 180° by actuation of an air motor and a clamp mechanism 20 carried on a bottom of the rotary head 19.

As shown in FIGS. 1 and 2, a ceiling rail 21 is arranged on the upper member of the main machine frame 15 at the assembly station B to extend parallel to the widthwise direction of the casting roll unit U. A nozzle preheating furnace 22 is installed below an end of the ceiling rail 21 to preheat the delivery nozzle 8. A gas furnace 23 is installed below the other end of the ceiling rail 21 so as to preheat the tundish 10.

A telescopic, nozzle robot device 25 is arranged on the ceiling rail 21 above the nozzle preheating furnace 22 and has a clamp mechanism 24 at its lower end. Arranged on the ceiling rail 21 above the gas furnace 23 is a tundish robot device 26 (particulars thereof not shown) which can be lifted up and down while supporting the tundish 10. In FIG. 1, reference numeral 27 denotes a receptacle adjacent to the casting station A and to which the molten metal is transferred when it overflows through an overflow port 10*a* of the tundish 10 (FIG. 3) or when an emergency plug 10*b* is drawn out because of, for example, extreme deformation of a strip during a casting operation. Lift-up of a stopper rod 12*a* causes the ladle 12 to supply the molten metal via an outlet nozzle 12*b* and a refractory shroud 28 to the tundish 10.

Casting in accordance with a twin-roll caster with the above-mentioned construction will be conducted as follows.

Before starting of a casting operation, the side weirs 6, delivery nozzle 8 and tundish 10 are preheated by the furnaces 13, 22 and 23, respectively; and the casting roll unit U is displaced to the assembly station B. All the tundish 10, delivery nozzle 8 and side weirs 6 are preheated to use temperature which is, in the case of iron casting, on the order of 1200–1300° C.

The nozzle robot device 25 is displaced to above the nozzle preheating furnace 22 and is expanded to clamp the delivery nozzle 8 preheated in the nozzle preheating furnace 22, through the clamp mechanism 24. Then, the nozzle robot device is contracted and runs along the ceiling rail 21 to a position of the casting roll unit U where the nozzle robot device 25 is expanded to position the delivery nozzle on and in the mounting bracket 9 of the carriage frame 3 of the casting roll carriage 2. Then, the clamp mechanism 24 is released and the nozzle robot device 25 is contracted and runs toward the nozzle preheating furnace 22 into a stand-by position.

Next, the tundish robot device 26 is displaced to above the gas furnace 23 and is expanded to bear the tundish 10 preheated in the gas furnace 23. Then, the robot device is contracted and runs along the ceiling rail 21 to the position of the casting roll unit U where the tundish robot device 26 is expanded to position and fix the tundish 10 via its mounting bracket 11 on and to the carriage frame 3 of the casting roll carriage 2. Then, the tundish robot device 26 is contracted to be withdrawn toward the gas furnace 23 into a stand-by position.

Then, the casting roll unit U with the delivery nozzle 8 and tundish 10 is displaced from the assembly station B to the casting station A.

With the rotary heads 19 being rotated such that the clamp mechanisms 20 of the side-weir robot devices 14 at the widthwise opposite ends of the casting roll unit U are directed to the corresponding heater furnaces 13, the side-weir robot devices 14 are expanded to clamp the side weirs 6 preheated in the heater furnaces 13 through the clamp mechanisms 20; then, the side-weir robot devices 14 are contracted to take the side weirs 6 out of the heater furnaces 13. The clamp mechanisms 20 are then rotated over 180° by the rotary heads 19 and the side-weir robot devices 14 are expanded to locate the side weirs 6 on the plate holders 5*b* of the side-weir mounting/dismounting devices 4; and the clamp mechanisms 20 are released and the side-weir robot devices 14 are contracted, which leaves the side weirs 6 on the plate holders 5*b*. The hydraulic cylinder units 5*a* are then expanded to engage the side weirs 6 with the opposite stepped ends 7 of the casting rolls 1 of the casting roll unit U positioned at the casting station A, thereby closing the opposite ends of the casting rolls 1.

With the casting rolls 1 being rotated while being water-cooled, the ladle 12 is displaced to above the tundish 10; and lift-up of the stopper rod 12*a* causes the molten metal to flow from the ladle 12 via the outlet nozzle 12*b* and refractory shroud 28 to the tundish 10 so that the molten metal is supplied via the delivery nozzle 8 to between the casting rolls 1; and shells solidify on the casting rolls 1 into the nip, resulting in a solidified strip produced at roll exit.

However, in the conventional apparatus shown in FIGS. 1–4, first of all, the casting roll unit U is displaced to the assembly station B. Installed on the casting roll unit U are the preheated delivery nozzle 8 through running and expansion/contraction of the nozzle robot device 25 as well as the preheated tundish 10 through running and expansion/contraction of the tundish robot device 26. Then, the roll unit U is displaced from the assembly station B to the casting station A where the preheated side weirs 6 are installed on the plate holders 5*b* of the side-weir mounting/dismounting device 4 through expansion/contraction of the side-weir robot device 14 and rotation of the rotary heads 19. Thus, the conventional apparatus is problematic or disadvantageous in that displacement motions of the respective preheated members or delivery nozzle 8, tundish 10 and side weirs 6 become complicated and require much time for such series of operations, that the entire apparatus becomes complicated and large-sized and that position control is much troublesome since a great number of limit switches are required for controlled decelerations of the respective preheated members so as to accurately position the same.

Moreover, as mentioned above, much time is required until installation of all the preheated members on the casting roll unit U is completed, which will result in a problem that especially the side weirs 6 and delivery nozzle 8 which are less voluminous than the tundish 10 tend to become low-temperatured before such completion of the installation. In particular, structurally, installation of the delivery nozzle 8, which is installed on the casting roll unit U at the assembly station B, must precede that of the tundish 10. That is, in the conventional construction, the preheated members are installed in a specific order and the delivery nozzle 8 must be arranged first. In other words, the delivery nozzle 8, which is less voluminous, has to await the installation of the side weirs 6 being completed, leading to a problem that the nozzle is allowed to cool and the molten metal may solidify in the delivery nozzle 8.

In order to overcome such problem in particular, temperature lowering of the delivery nozzle 8 must be taken into account to preheat the delivery nozzle 8 to a temperature by far higher than that of the molten metal, which may lead to a fact that much time is needed for the preheating and consumed energy is increased. There may be also a problem of deteriorated strength of the nozzle due to extreme high-temperature heating.

The present invention was made in view of the above-mentioned conventional problems. An object of the invention is to provide an apparatus for displacing preheated members for a twin-roll caster that is simple in structure and that can promptly install preheated side weirs and delivery nozzle or nozzles on a casting roll unit.

SUMMARY OF THE INVENTION

According to the invention, a casting roll unit with side weirs and a delivery nozzle being detachably attached thereto is arranged at a casting position. Side-weir and delivery-nozzle preheating furnaces are arranged away from the casting roll unit. Arranged adjacent to the casting roll unit are displacing robots which can selectively clamp the side weirs and the delivery nozzle and which are displaced between the casting roll unit and the side-weir or delivery-nozzle preheating furnace for installation/removal of the side weirs or delivery nozzle. As a result, installation/removal of the side weirs or delivery nozzle can be effected only through actuation of the displacing robots and without movement of the casting roll unit, whereby the construction around the casting roll unit can be substantially simplified. Moreover, the operations and routes for installing/removing the side weirs and the delivery nozzle may be learnt by and preliminarily stored in the displacing robots so that installation/removal of the side weirs and the delivery nozzle can be effected automatically, simply and promptly in a short time. Unlike the prior art, no order is specified for installing the side weirs and the delivery nozzle and they may be freely installed with no order for installation, which fact may expand a range of selectable options in operation.

The displacing robots may be two in number, spaced apart from each other widthwise of the casting roll unit, and arranged between the side-weir and delivery-nozzle preheating furnaces spaced apart from each other perpendicularly of the widthwise direction of the casting roll unit. As a result, installation of the displacing robots substantially midway between the casting roll unit and the side weir or delivery nozzle will shorten the travel distance of the displacing robots for positioning the side weir or delivery nozzle, thereby further shortening the work time for installation/removal of the side weir or delivery nozzle.

Each of the displacing robots may comprise a clamp device with side-weir and delivery-nozzle clamps at its tip, at least three articular mechanisms with three arms and at least two swivel mechanisms, the first swivel mechanism being capable of switching an object or objects to be clamped by rotating the clamp device in a vertical plane, the first articular mechanism being capable of keeping vertical the side weir or delivery nozzle clamped by the clamp device, the second and third articular mechanisms being capable of vertically moving the side weir or delivery nozzle clamped to install/remove it onto/from the casting roll unit and the side-weir or delivery-nozzle preheating furnace, the second swivel mechanism being capable of swiveling the clamped side weir or delivery nozzle to displace it between the casting roll unit and the side-weir or delivery-nozzle preheating furnace. This enables prompt installation/removal of the side weir and delivery nozzle in a short time merely through actuation of the displacing robots, which can prevent a problem of molten metal being solidified through cooling of the preheated members, thereby preventing a conventionally prolonged preheating time due to preheating of the members to be preheated to high temperatures with temperature lowering being taken into consideration as well as deteriorated strength due to increased consumed energy and extremely high heating.

The clamp device and the respective arms may be provided with water coolers; and the clamp devices and the swivel and articular mechanisms may be provided with expandable and contractible heat insulators, which can protect the displacing robots from heat.

BEST MODE FOR CARRYING OUT THE INVENTION

Figure 1:
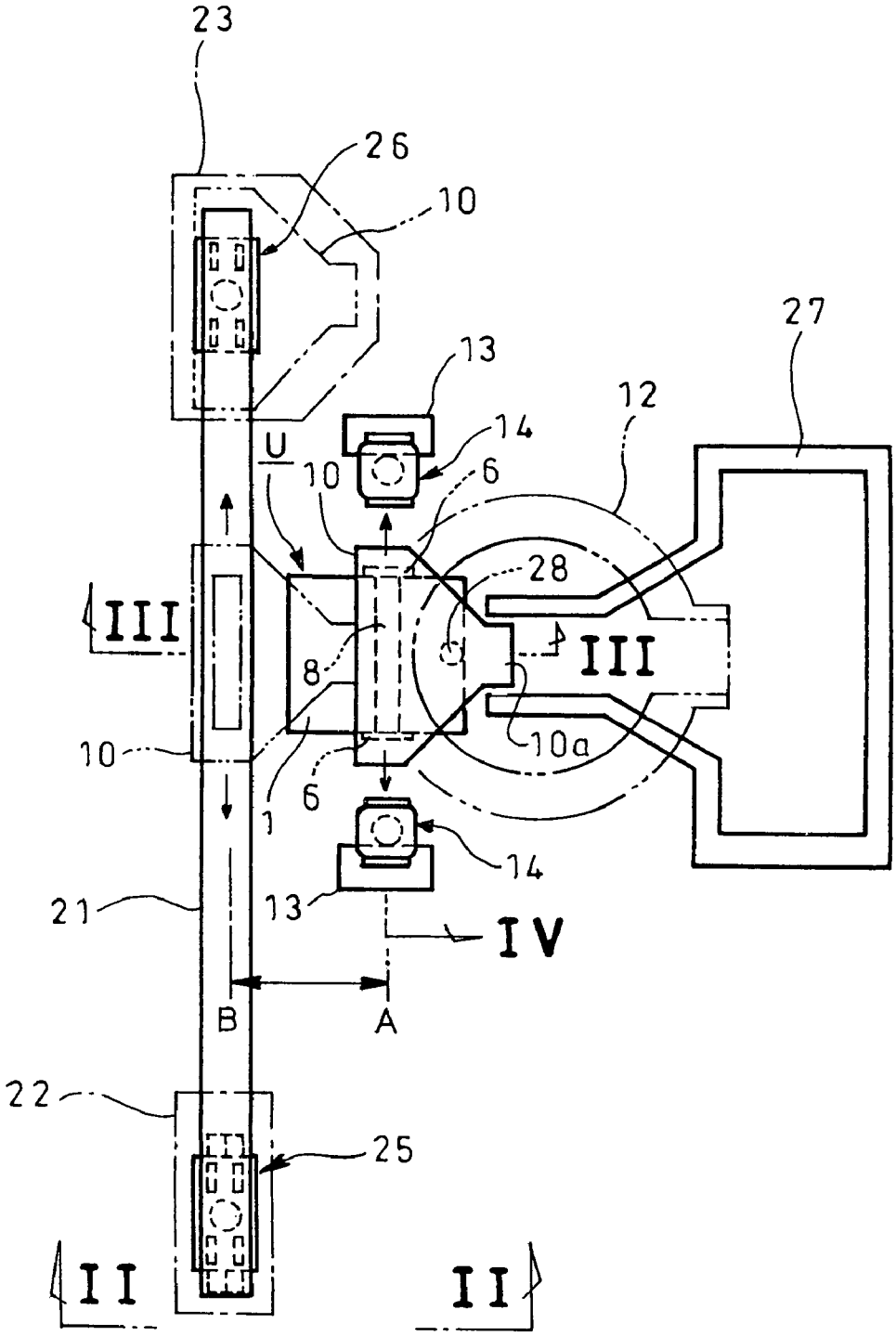
FIG. 1 is a plan view showing a conventional twin-roll caster.
Figure 2:
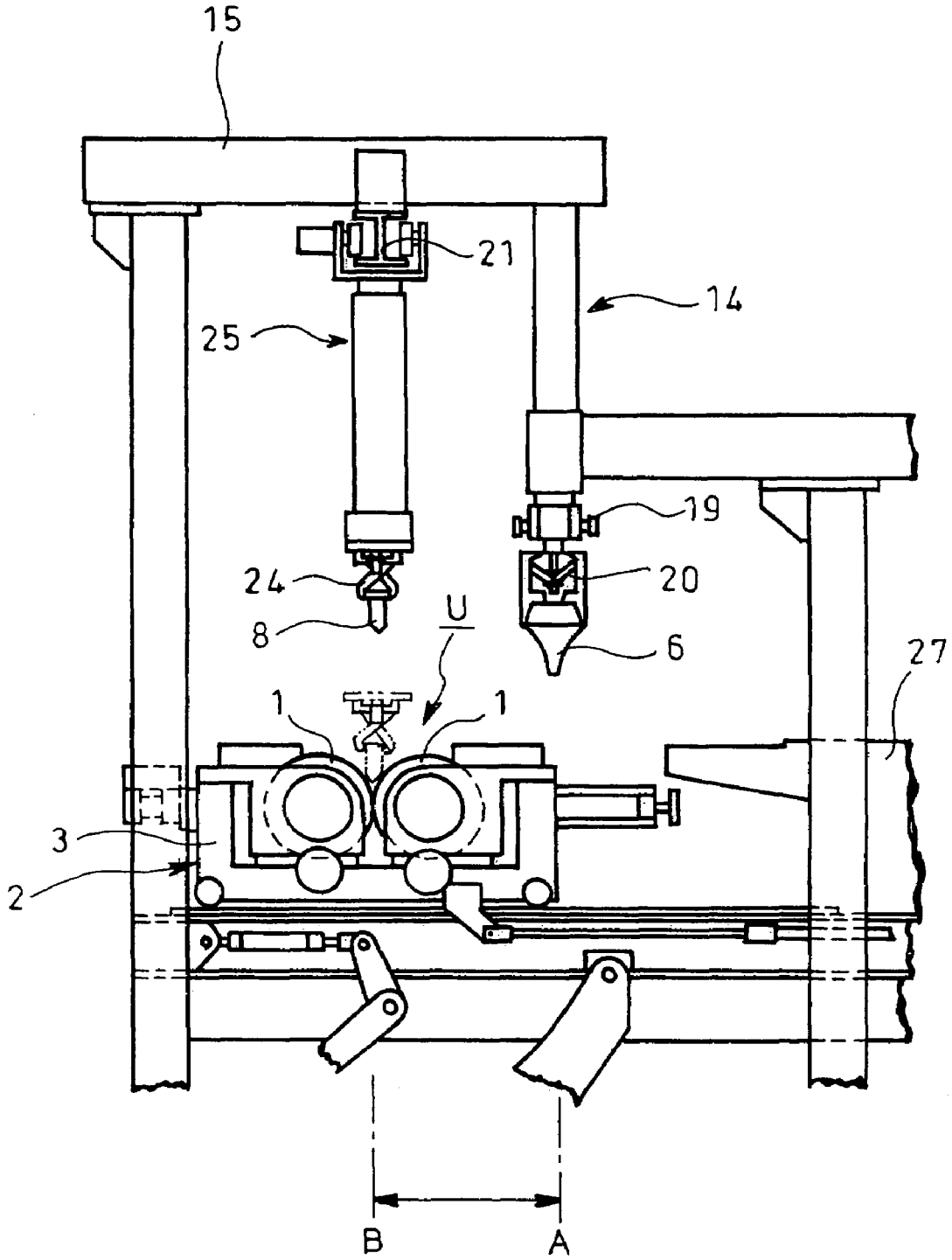
FIG. 2 is a view looking in the direction of arrows II in FIG. 1.
Figure 3:
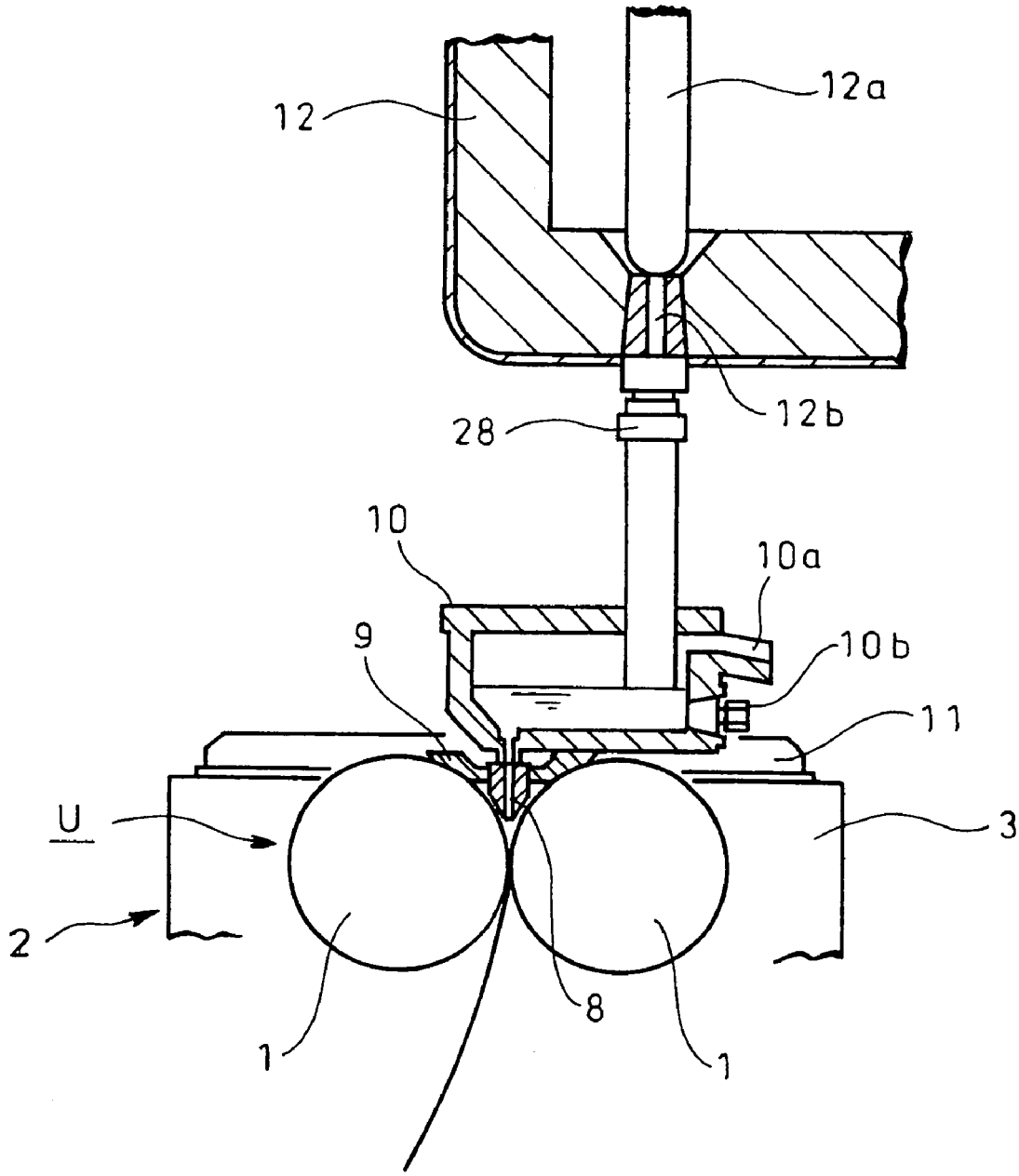
FIG. 3 is a view looking in the direction of arrows III in FIG. 1.
Figure 4:
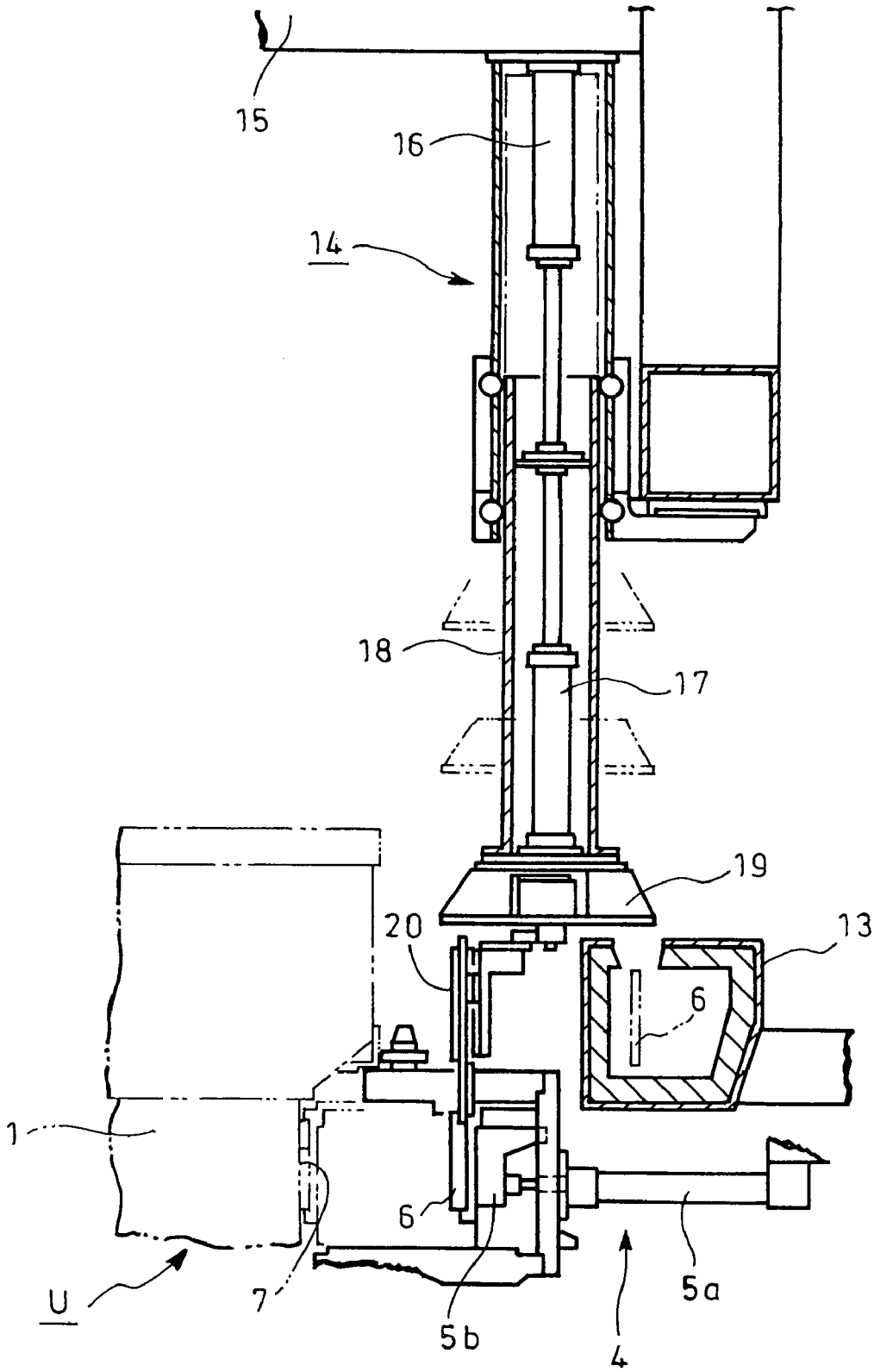
FIG. 4 is a view looking in the direction of arrow IV in FIG. 1.

An embodiment of the invention will be described with reference to the drawings.

FIGS. 5 to 12 show the embodiment of an apparatus for displacing preheated members for a twin-roll caster according to the invention in which structural parts similar to those shown in FIGS. 1–4 are designated by the same reference numerals and explanation thereon is omitted.

Figure 5:
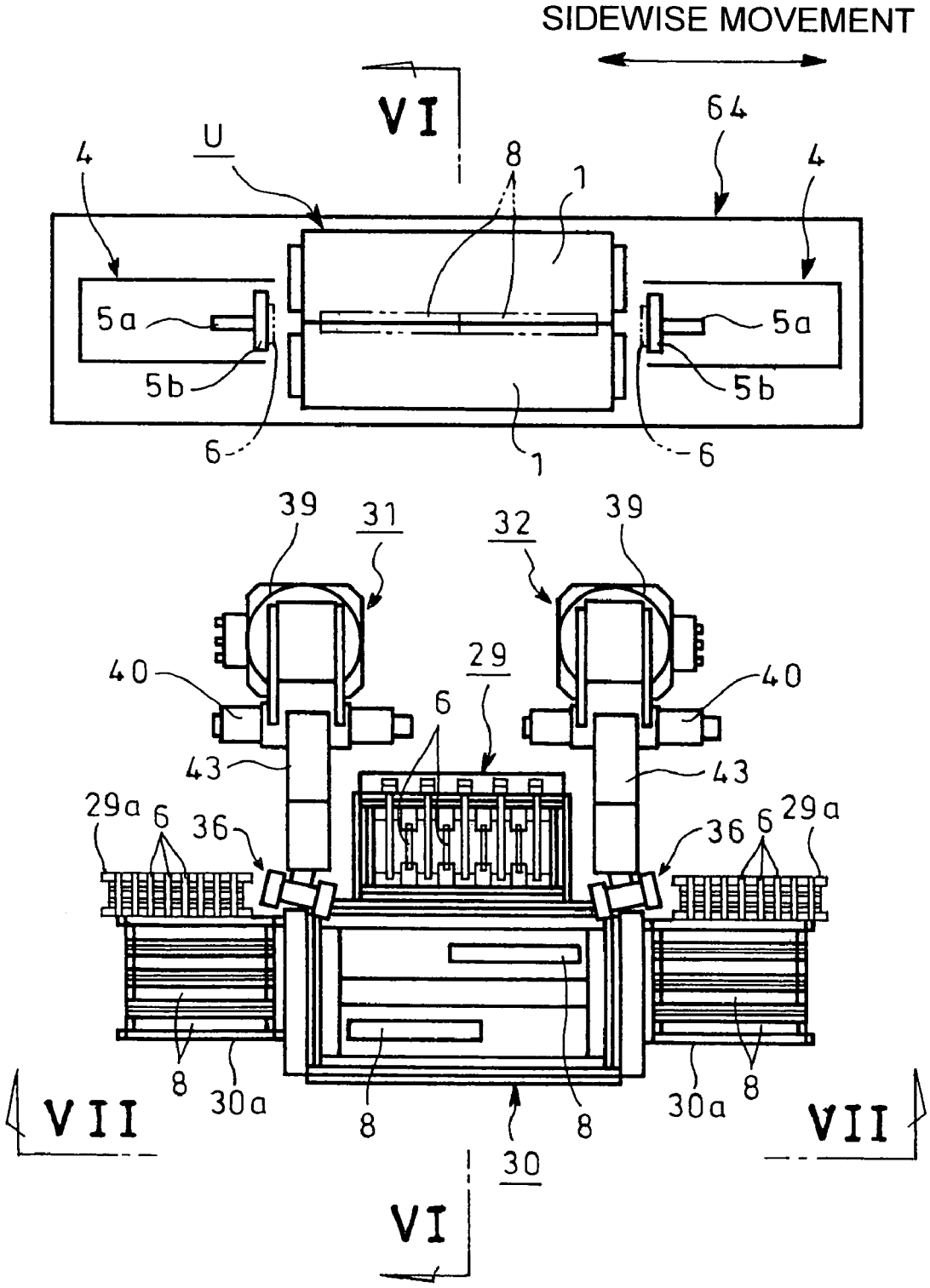
FIG. 5 is a plan view showing an embodiment of an apparatus for displacing preheated members for a twin-roll caster according to the invention.
Figure 6:
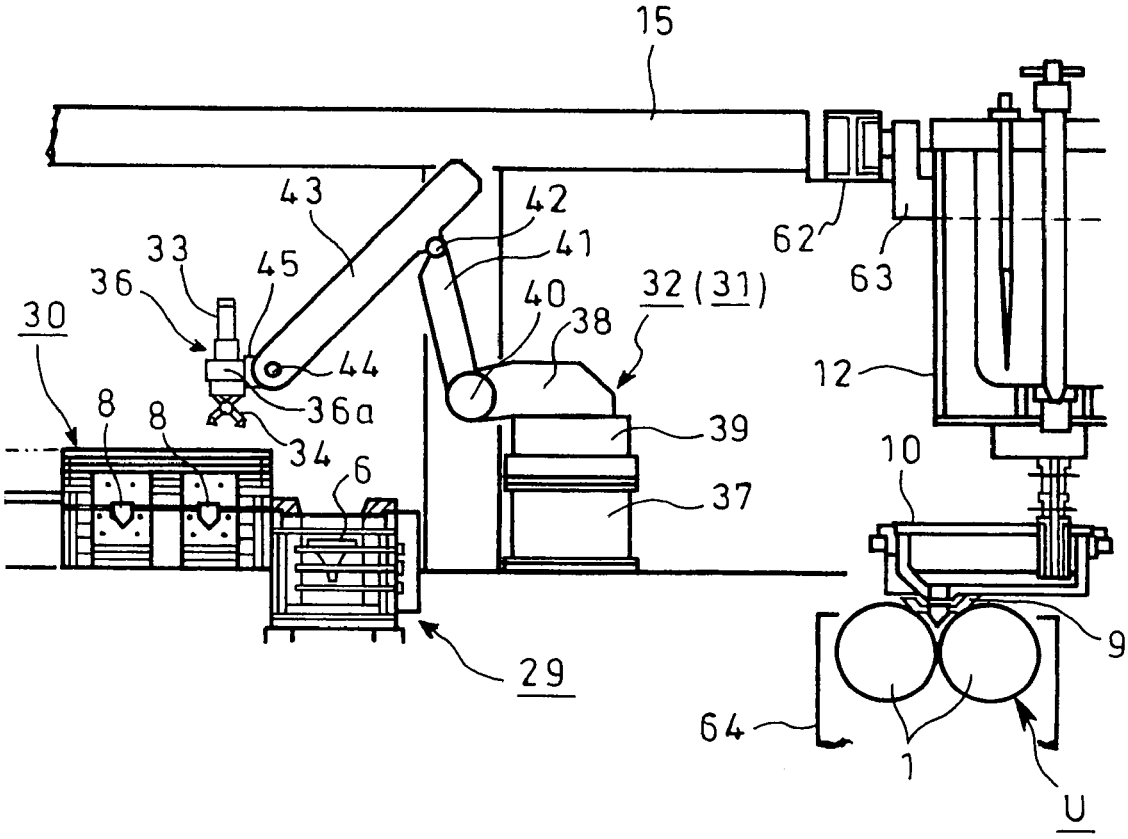
FIG. 6 is a view looking in the direction of arrows VI in FIG. 5.
Figure 7:
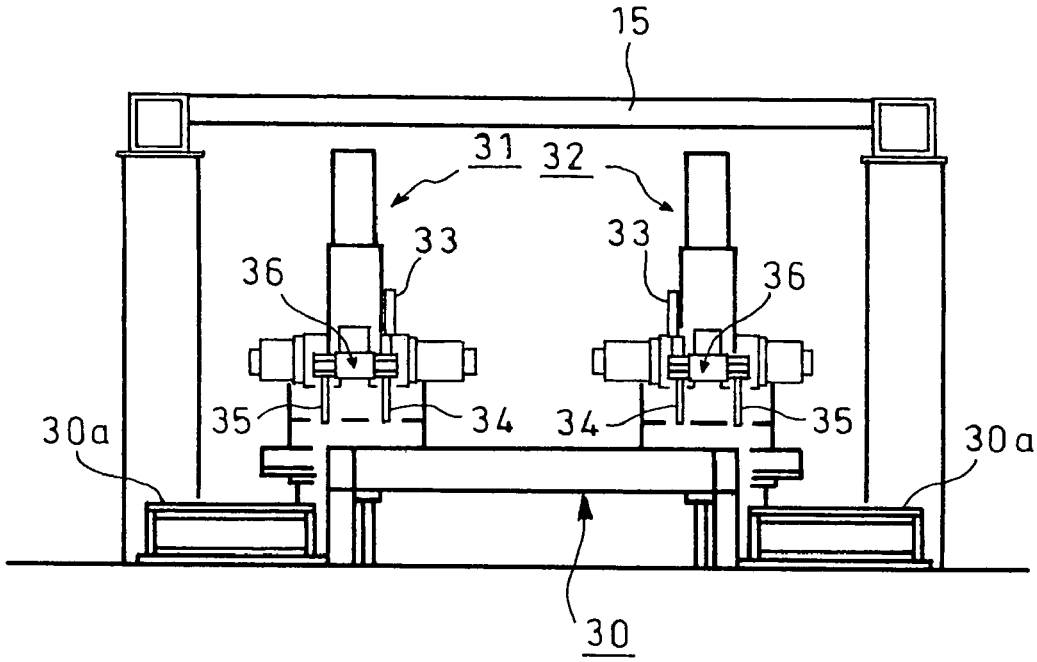
FIG. 7 is a view looking in the direction of arrows VII in FIG. 5.

FIGS. 5–7 show the whole of the construction according to the invention which is definitely different from the conventional apparatus shown in FIGS. 1–4 in that a casting roll unit U is arranged at a casting position.

As shown in FIGS. 5 and 6, the casting roll unit U is supported by a roll carriage 64 on which arranged are side-weir mounting/demounting devices 4 widthwise and outwardly of the casting roll unit U. The roll carriage 64 is adapted to be displaced or moved sidewise or widthwise of the casting roll unit U and between a casting position (position shown in FIG. 5) and a roll replacement position.

Side-weir and delivery-nozzle preheating furnaces 29 and 30 are arranged at positions perpendicularly away from a widthwise direction of the casting roll unit U. The side-weir preheating furnace 29 is adapted to accommodate and preheat plural side weirs 6 in directions parallel to directions at which the side weirs 6 are installed on the casting roll unit U. The delivery-nozzle preheating furnace 30 is adapted to accommodate and preheat plural delivery nozzles 8 in directions parallel to a direction at which the delivery nozzle or nozzles 8 are installed on the casting roll unit U. FIG. 5 shows an example where two delivery nozzles 8 are arranged in tandem widthwise of the casting roll unit U; therefore, the preheating furnace 30 is adapted to preheat the two delivery nozzles 8 at once. However, in a case where a single delivery nozzle 8 is arranged in the casting roll unit U, the delivery-nozzle preheating furnace 30 may be of a type which preheats a single delivery nozzle 8. In FIG. 5, reference numerals 29*a* and 30*a* denote temporary depot stands for the side weirs 6 and the delivery nozzles 8, respectively.

Two displacing robots 31 and 32 are arranged between the casting roll unit U and the side-weir and delivery-nozzle preheating furnaces 29 and 30 and are spaced apart from each other at a spacing corresponding to that between widthwise ends of the casting roll unit U. These displacing robots 31 and 32 are adapted to clamp the side weir 6 or delivery nozzle 8 and to be displaced between the roll unit U and the preheating furnace 29 and between the roll unit U and the preheating furnace 30 for installation/removal of the side weir 6 and delivery nozzle 8. In this respect, preferably the displacing robots 31 and 32 are situated at positions approximately midway between the casting roll unit U and side-weir preheating furnace 29 and between the casting roll unit U and delivery-nozzle preheating furnace 30.

Each of the displacing robots 31 and 32 is provided with, as shown in FIGS. 6 and 7, a clamp device 36 having a side-weir clamp 33 and delivery-nozzle clamps 34 and 35 at its tip end as well as at least three articular and two swivel mechanisms.

More specifically, each of the displacing robots 31 and 32 comprises, as shown in FIG. 6, a second swivel mechanism 39 in the form of a horizontally swingable swivel stand 38 on a fixed stand 37, a third arm 41 pivoted at its lower end to the stand 38 so as to be angularly displaceable via a third articular mechanism 40, a second arm 43 pivoted via a second articular mechanism 42 to an upper end of the third arm 41 such that an upper end of the second arm is swingable forward and backward (in a direction toward and away from the fixed stand 37), a first arm 45 vertically swingably pivoted at its one end via a first articular mechanism 44 to a lower end of the second arm 43 and extending forwardly (in a direction away from the fixed stand 37) and the clamp device 36 on the first arm 45 to rotate in a vertical plane via a first swivel mechanism 36*a*.

Figure 8:
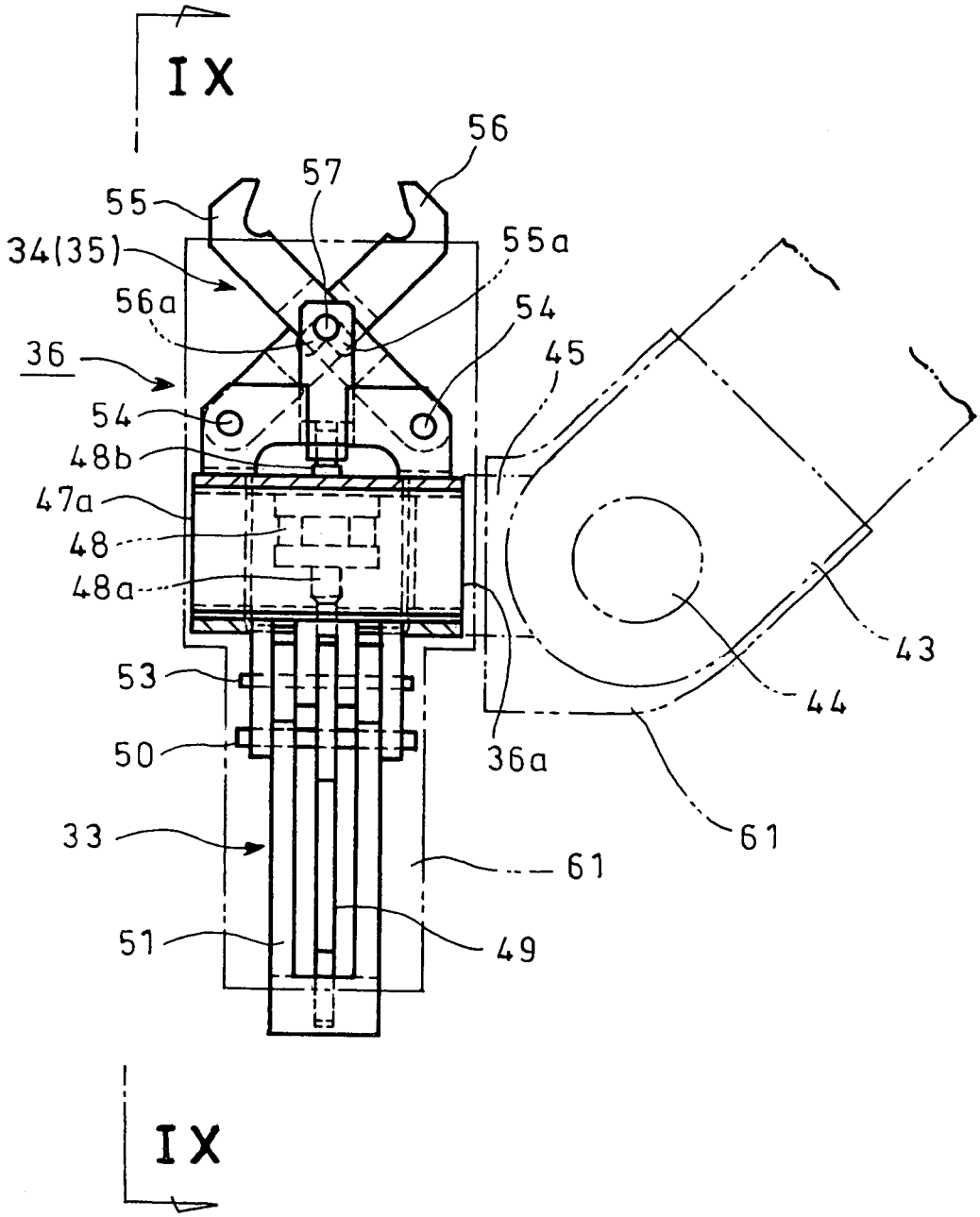
FIG. 8 is a side view showing particulars of a clamping device in FIG. 6.
Figure 9:
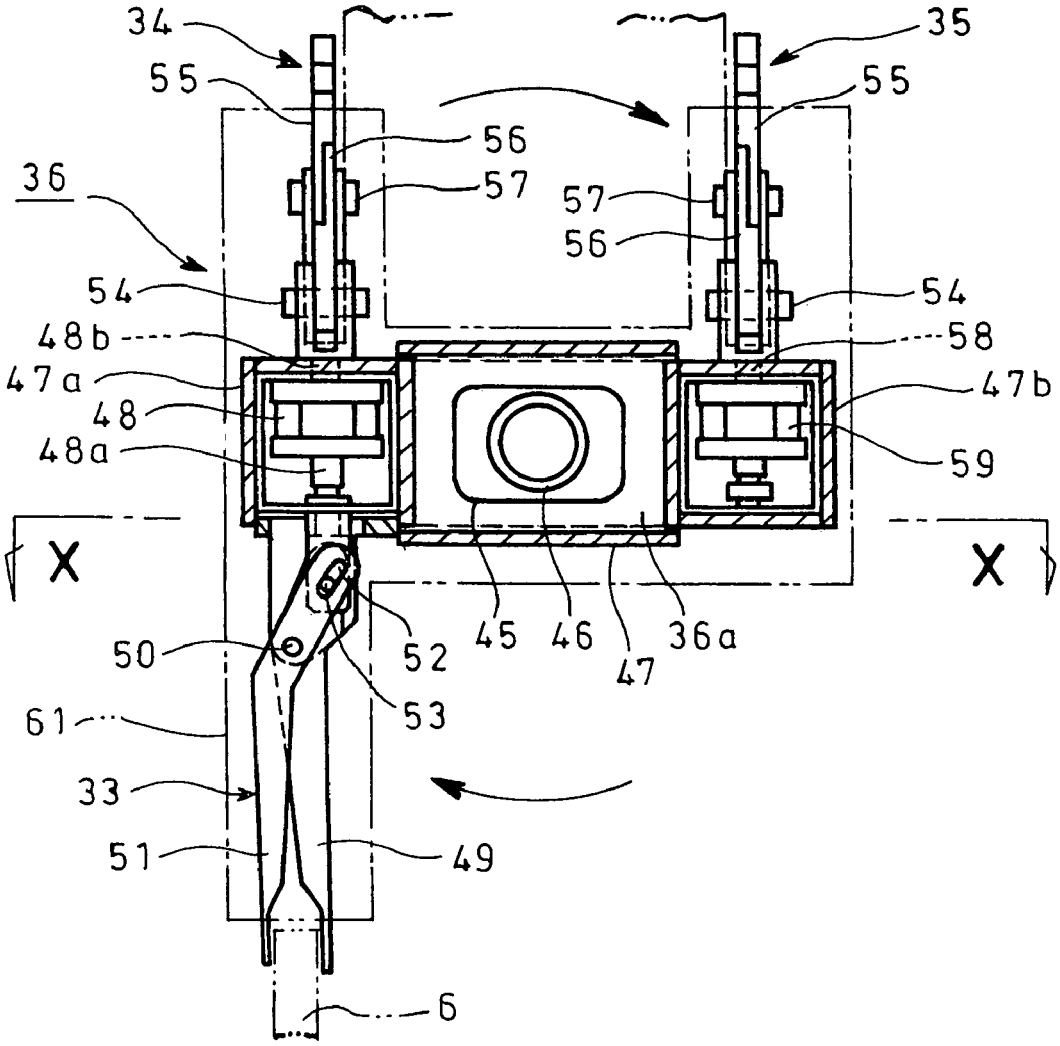
FIG. 9 is a view looking in the direction of arrows IX in FIG. 8.
Figure 10:
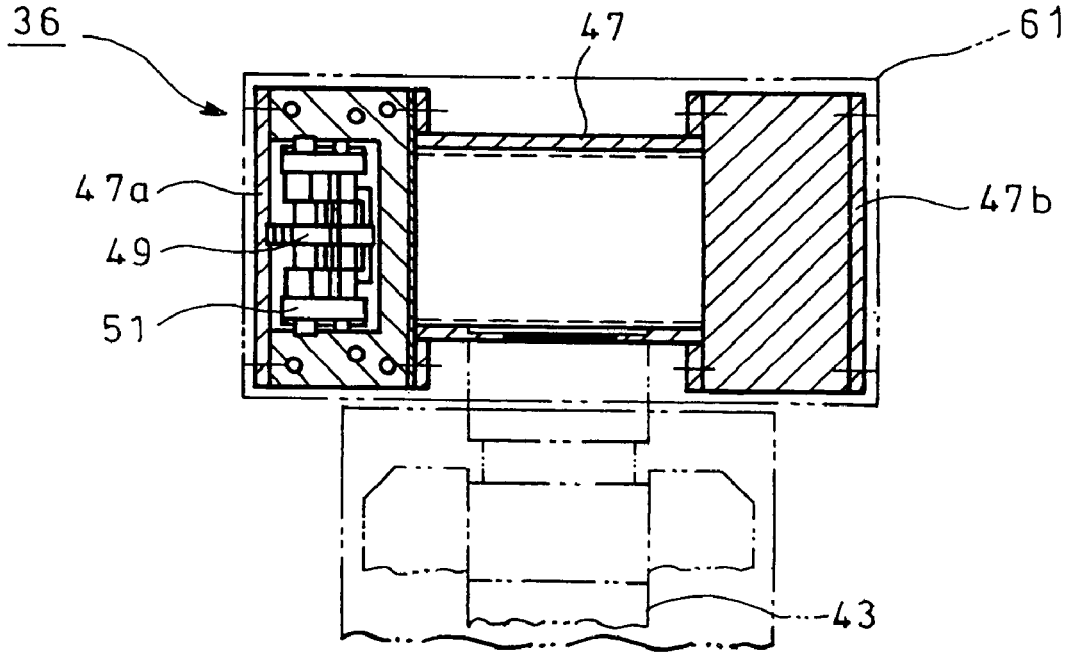
FIG. 10 is a view looking in the direction of arrows X in FIG. 9.

FIGS. 8–10 show particulars of the clamp device 36 which comprises a shaft 46 extending ahead of the first arm 45 and a rotary block 47 rotatably and laterally extending perpendicular to an axis of the shaft 46 to have opposite ends 47*a* and 47*b*. The rotary block 47 is adapted to be rotated by the first swivel mechanism 36*a* through a motor or the like (not shown) in the shaft 46 or in the rotary block 47.

The rotary block 47 has at its one end 47*a* a vertically expandable and contractible inner double-acting cylinder 48 perpendicular to a longitudinal axis of the rotary block 47 and to the axis of the shaft 46. The inner double-acting cylinder 48 has the side-weir clamp 33 at its one side (lower side in FIG. 9) and the delivery nozzle clamp 34 at the other side (upper side in FIG. 9).

Figure 11:
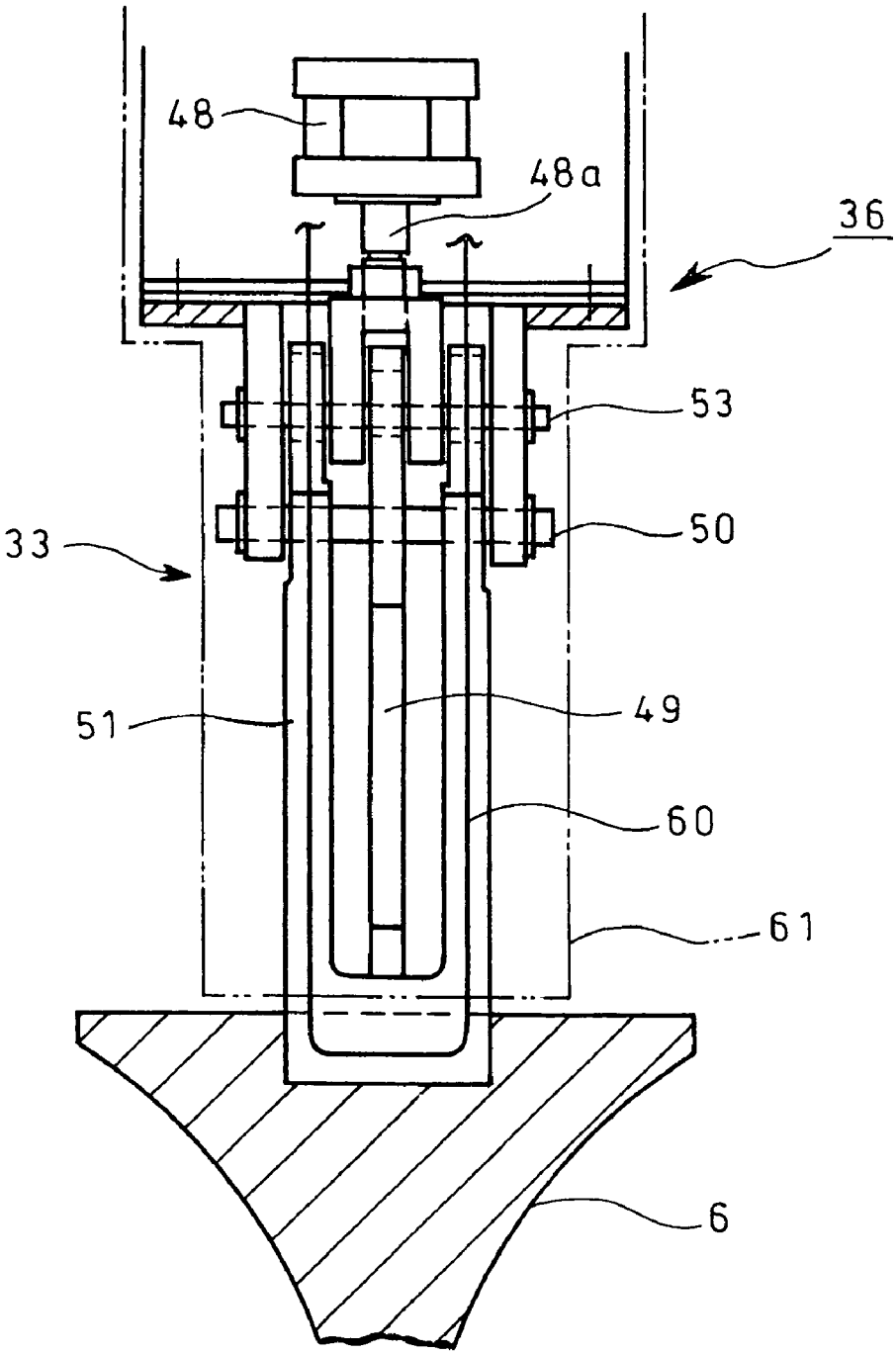
FIG. 11 is a front view showing a state that a side-weir clamp clamps a side weir.

The side-weir clamp 33 comprises a fixed claw 49 extending downward from a lower surface of the end 47*a* of the rotary block 47 and a rotary claw 51 pivoted via a pin 50 to an intermediate portion of the fixed claw 49. One end shaft 48*a* of the cylinder 48 is engaged via a pin 53 with a slanting slot 52 on an upper end of the cylinder 48 so that a tip of the rotary claw 51 is moved toward and away from the fixed claw 49 by contracting and expanding the one end shaft 48*a* of the inner double-acting cylinder 48, which enables lateral clamp of an upper edge of the side weir 6 at its intermediate position as shown in FIG. 11.

The delivery-nozzle clamps 34 comprises rotary claws 55 and 56 pivoted at their lower ends via pins 54 at forward and backward positions on an upper surface of the one end 47*a* of the rotary block 47 in the form of letter X as shown in the side view or FIG. 8. Crossed portions of the claws 55 and 56 are respectively formed with slots 55*a* and 56*a* extending longitudinally of the respective claws. The claws 55 and 56 are mounted at their slots 55*a* and 56*a* via a pin 57 to the other end shaft 48*b* of the inner double-acting cylinder 48 so that tips of the claws 55 and 56 are mutually moved toward and away from each other by contracting and expanding the other end shaft 48*b* of the inner double-acting cylinder 48, which enables clamp of an upper edge of the delivery nozzle 8 at its front and rear at a position adjacent to one side end of the nozzle 8 as shown in FIG. 12.

The other end 47*b* of the rotary block 47 is provided with an expansion and contraction cylinder 59 which is in parallel with the inner double-acting cylinder 48 and which has a working shaft 58 capable of expanding and contracting upward. Arranged on an upper surface of the other end 47*b* of the rotary block 47 is a delivery-nozzle clamp 35 which can clamp the upper edge of the delivery nozzle 8 at its other side end through expansion and contraction of the working shaft 58 of the expansion and contraction cylinder 59, the delivery-nozzle clamp 35 being substantially the same in structure as the delivery-nozzle clamp 34. The delivery-nozzle clamps 34 and 35, which are longitudinally spaced apart from each other as mentioned above, clamp the widthwise long delivery nozzle 8 in a stable manner at the widthwise two positions.

The clamp devices 36 of the two displacing robots 31 and 32 arranged in conformity with the widthwise ends of the casting roll unit U are laterally symmetrical in structure as shown in FIG. 7.

Figure 12:
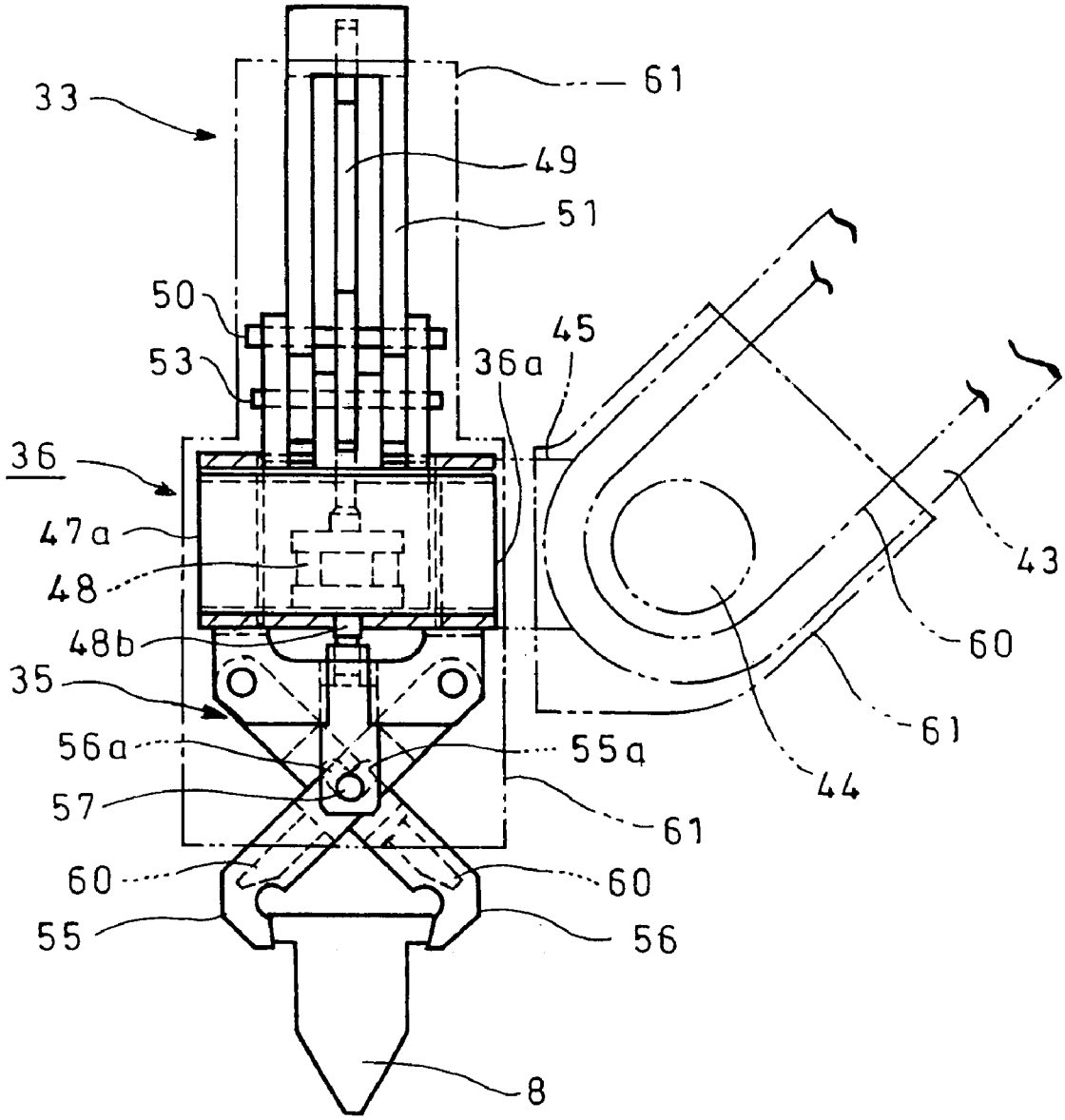
FIG. 12 is a side view showing a state that a nozzle clamp clamps a delivery nozzle.

As exemplarily shown in FIGS. 11 and 12, a chilled water pipe 60 is arranged along each of the clamp devices 36 of the displacing robots 31 and 32 and the first to third arms 45, 43 and 41 to provides a water cooler.

Furthermore, as exemplarily shown in FIGS. 8–12, the clamp devices 36 and the first and second swivel mechanisms 36*a* and 39 and the first to third articular mechanisms 44, 42 and 40 are provided outward with expandable and contractible heat insulators 61 so as to protect them from heat.

The displacing robots 31 and 32 are for prompt arrangement of the preheated side weir 6 and delivery nozzle or nozzles 8 on the casting roll unit U and therefore the displacing robots 31 and 32 do not deal with the tundish. As shown in FIG. 6, the tundish 10 is preheated by a preheating furnace arranged at a different position (not shown); the preheated tundish 10 is displaced, for example together with the ladle 12 supported by the roll carriage 63 running along the ceiling rail 62 of the main machine frame 15, and is installed on the casting roll unit U fixed to the casting position.

The mode of operation of the above embodiment will be described.

An operation and course for displacement of the side weirs 6 between the side-weir preheating furnace 29 and the plate holders 5*b* of the side-weir mounting/dismounting devices 4 widthwise outward of the casting roll unit U for installation/removal of the side weirs 6 are preliminarily learned by and stored in the displacing robots 31 and 32; an operation and course for displacement of the delivery nozzle 8 between the preheating furnace 30 and the mounting bracket 9 (FIG. 6) on the carriage frame of the roll carriage 63 on the casting roll unit U for installation/removal of the delivery nozzle 8 are also preliminarily learned by and stored in the displacing robots 31 and 32.

Further, before starting of a casting operation, the two side weirs 6 and two delivery nozzles 8 have been preheated by the preheating furnaces 29 and 30, respectively. The tundish 10 shown in FIG. 6 has been preheated by the different preheating furnace (not shown).

In order to install the preheated side weirs 6 and delivery nozzles 8 on the casting roll unit U, first the rotary block 47 is rotated by the first swivel mechanism 36*a* in the vertical plane into a state of FIGS. 8 and 9 such that the side-weir clamps 33 of the two displacing robots 31 and 32 are directed downward; and the respective displacing robots 31 and 32 are swiveled by actuating the second swivel mechanisms 39 shown in FIGS. 5 and 6 to respectively position the side-weir clamps 33 above predetermined side weirs 6 in the side weir preheating furnace 29. In this respect, with respect to each of the side-weir clamps 33, the lower end of the rotary claw 51 is open and away from the fixed claw 49 by expanding the one end shaft 8*a* of the inner double-acting cylinder 48. Then, the side-weir clamps 33 are lowered by actuation of the second and third articular mechanisms 42 and 40 into a state where they can clamp the side weir 6 while the side-weir clamps 33 are controlled by the first articular mechanism 44 to be kept in a vertical state.

Then, the one end shaft 48*a* of the inner double-acting cylinder 48 is contracted to make the lower end of the rotary claw 51 access the fixed claw 49; as a result, the upper edge of the side weir 6 at its intermediate position as shown in FIG. 11 is clamped.

Then, the side-weir clamps 33 are elevated by actuating the second and third articular mechanisms 42 and 40 of the displacing robots 31 and 32; the displacing robots 31 and 32 are rotated substantially over 180° to position the side weirs 6 above the plate holders 5*b* of the side-weir mounting/dismounting devices 4 widthwise outward of the casting roll unit U; then, the side weirs 6 are lowered by actuating the second and third articular mechanisms 42 and 40 onto the plate holders 5*b*. Then, the one end shaft 48*a* of the inner double-acting cylinder 48 is expanded to release the clamping of the side weir 6 by the side-weir clamps 33; the side-weir clamps 33 are elevated by actuating the second and third articular mechanisms 42 and 40, resulting in completion of the installation of the side weirs 6 on the plate holders 5*b*.

In the above, the side-weir preheating furnace 29 preheats the side weirs 6 in directions in parallel with the direction at which the side weirs 6 are installed on the casting roll unit U, so that mere clamping and rotation over 180° of the preheated side weirs 6 by the displacing robots 31 and 32 can cause the installation f the side weirs 6 on the plate holders 5*b* with their directions being aligned, thereby minimizing the adjustment for positioning the side weirs 6. Moreover, the displacing robots 31 and 32 are installed substantially midway between the casting roll unit U and the side-weir preheating furnace 29, so that travel distance of the displacing robots 31 and 32 for positioning the side weirs 6 may be shortened.

Then, the rotary block 47 is rotated on the vertical plane by the first swivel mechanism 36*a* into the state shown in FIGS. 6, 7 and 12 such that the delivery-nozzle clamps 34 and 35 of the two displacing robots 31 and 32 are directed downward; the displacing robots 31 and 32 are swiveled by actuating the second swivel mechanisms 39 of FIGS. 5 and 6 so that the delivery-nozzle clamps 34 and 35 are respectively above the predetermined delivery nozzles 8 in the delivery-nozzle preheating furnace 30. In this connection, with respect to the delivery-nozzle clamps 34 and 35, the lower ends of the rotary claws 55 and 56 are made spaced apart from each other into an open state by contracting the other end shaft 48*b* of the inner double-acting cylinder 48 and the working shaft 58 of the expansion and contraction cylinder 59. Consequently, actuation of the second and third articular mechanisms 42 and 40 causes the delivery-nozzle clamps 34 and 35 to lower into a state where the delivery nozzle 8 can be clamped. In this case, the delivery-nozzle clamps 34 and 35 are always controlled by the first articular mechanism 44 to be kept in a vertical position.

Then, the other end shaft 48*b* of the inner double-acting cylinder 48 and the working shaft 58 of the expansion and contraction cylinder 59 are concurrently expanded to make the lower ends of the rotary claws 55 and 56 access to each other, so that the upper end of the side weir 6 is clamped as shown in FIG. 12 at widthwise two positions, respectively.

Then, the second and third articular mechanisms 42 and 40 of the respective displacing robots 31 and 32 are actuated to elevate the delivery-nozzle clamps 34 and 35 and, by actuation of the second swivel mechanism 39, the displacing robots 31 and 32 are rotated substantially over 180°, so that the delivery nozzle 8 is positioned above the mounting bracket 9 on the carriage frame of the roll carriage 64 shown in FIG. 6; thereafter, the delivery nozzle 8 is lowered by actuating the second and third articular mechanisms 42 and 40 so that the delivery nozzle 8 is installed on the mounting bracket 9.

Then, the other end shaft 48*b* of the inner double-acting cylinder 48 and the work shaft 58 of the expansion cylinder 59 are contracted to release the clamping of the delivery nozzle 8 by the delivery-nozzle clamps 34 and 35; and the delivery-nozzle clamps 34 and 35 are elevated by actuation of the second and third articular mechanisms 42 and 40 so that the arrangement of the delivery nozzle 8 on the mounting bracket 9 is completed.

In the above, the preheating furnace 30 preheats the delivery nozzle 8 in a direction parallel to the direction at which the delivery nozzle 8 is installed on the casting roll unit U, so that mere clamping and rotation over 180° of the preheated delivery nozzle 8 by the displacing robots 31 and 32 will cause the delivery nozzle 8 to be installed on the mounting bracket 9 with its direction being aligned, thereby minimizing the adjustment for positioning the delivery nozzle 8. Moreover, the displacing robots 31 and 32 are installed substantially midway between the casting roll unit U and the delivery-nozzle preheating furnace 30, so that the travel distance of the displacing robots 31 and 32 for positioning the delivery nozzle 8 can be shortened.

After completion of the above-mentioned installation of the side weir 6 and delivery nozzle 8, the preheated tundish 10 is displaced by the roll carriage 63 at a position not shown in FIG. 6 onto the casting roll unit U, thus completing the arrangement of all the preheated members on the casting roll unit U.

The displacing robots 31 and 32 can serve not only to install the preheated members on the casting roll unit U as mentioned above, but also to temporarily position the preheated members for the casting roll unit U on the temporary depot stands 29*a* and 30*a* or to install the preheated members on the temporary depot stands 29*a* and 30*a* to the side-weir or delivery-nozzle preheating furnace 29 or 30.

As shown in FIGS. 11 and 12, the chilled water pipes 60 are arranged for the clamp devices 36 of the displacing robots 31 and 32 and the first to third arms 45, 43 and 41 to provide water coolers, so that these structural members are protected from high temperatures.

Moreover, the expandable and contractible heat insulators 61 as shown in FIGS. 8–12 are provided outside of the clamp devices 36 and the first and second swivel mechanisms 36*a* and 39 and the first to third articular mechanisms 44, 42 and 40, so that these devices can be protected from heat.

As mentioned above, in an apparatus for replacing preheated members of a twin-roll caster according to the invention, the casting roll unit U is arranged at the casting position; the side-weir and delivery-nozzle preheating furnaces 29 and 30 are arranged away from the casting roll unit U; the replacing robots 31 and 32 are arranged adjacent to the casting roll unit U, said displacing robots 31 and 32 being capable of selectively clamping the side weir 6 and delivery nozzle 8 and being displaced between the casting roll unit U and the side-weir preheating furnace 29 or between the casting roll unit U and delivery-nozzle preheating furnace 30 for installation/removal of the side weir 6 or delivery nozzle 8. As a result, the installation/removal of the side weir 6 or delivery nozzle 8 can be made only by actuating the displacing robots 31 and 32 while the casting roll unit U being kept immovable. Thus, the structure around the casting roll unit U can be substantially simplified. By preliminarily leaning and store the operation and course of the installation/removal of the side weir 6 and the delivery nozzle 8 to the displacing robots 31 and 32, the installation/removal of the side weir 6 and delivery nozzle 8 can be made automatically and promptly in a short time.

Moreover, the displacing robots 31 and 32 are arranged at a position substantially midway between the casting roll unit U and the side weir 6 or delivery nozzle 8 so that travel distance of the displacing robots 31 and 32 for positioning the side weir 6 or delivery nozzle 8 can be shortened; as a result, work time for installation/removal of the side weir 6 and delivery nozzle 8 can be further shortened.

Moreover, installation/removal of the side weir 6 and delivery nozzle 8 can be carried out in a short time, which can prevent a problem of the molten metal being solidified by cooled preheated members, leading to preventing the problems of the elongated preheating time and the increased consumed energy owing to the fact that conventionally the members to be preheated are preheated to high temperatures with taking the expected temperature lowering into consideration and the problem of deteriorated strength due to high-temperature heating. Unlike the conventional art, the order for setting the preheated members is not specified and the side weir 6 and delivery nozzle 8 can be freely set, leading to enlargement of a range of selected operations.

Moreover, the displacing robots 31 and 32 are provided with the water coolers 60 and heat insulators 61 so that the displacing robots 31 and 32 can be protected from heat.

It is to be understood that above-mentioned embodiment is a mere example and that various changes and modifications may be effected within a scope of the invention. For example, substantial modifications may be carried out and the overall layout may be changed depending upon specific design on various components of the device.

INDUSTRIAL APPLICABILITY

With an apparatus for replacing preheated members in a twin-roll caster according to the invention, installation/removal of the side weirs and delivery nozzles which are to be preheated to install on a casting roll unit can be carried out only by the displacing robots with the casting roll unit being fixed; as a result, construction around the casting roll unit can be substantially simplified, and installation and removal of the side weirs and delivery nozzles can be promptly carried out in a short time.

The invention claimed is:

1. A casting system comprises an apparatus for displacing preheated members for a twin-roll caster, characterized in that a casting roll unit having side weirs and a delivery nozzle detachable therefrom is arranged in a casting position, side-weir and delivery-nozzle preheating furnaces being arranged away from said casting roll unit, a displacing robot being arranged adjacent to said casting roll unit, said displacing robot being capable of selectively clamping the side weirs and the delivery nozzle to be displaced between the casting roll unit and the side-weir preheating furnace or between the casting roll unit and the delivery-nozzle preheating furnace for installation/removal of the side weirs or the delivery nozzle.

2. The apparatus for displacing preheated members for a twin-roll caster according to claim 1, characterized by two displacing robots spaced apart from each other widthwise of the casting roll unit, said displacing robots being arranged between the casting roll unit and the side-weir and delivery-nozzle preheating furnaces, said furnaces being spaced apart from each other perpendicularly of the widthwise direction of the casting roll unit.

3. The apparatus for displacing preheated members for a twin-roll caster according to claim 1, characterized in that said displacing robot comprises a clamp device with side-weir and delivery-nozzle clamps at its tip, at least three articulate mechanism with three arms and at least two swivel mechanisms, the first swivel mechanism being capable of switching object or objects to be clamped by rotating the clamp device in a vertical plane, the first articular mechanism being capable of keeping vertical the side weir or delivery nozzle clamped by the clamp device, the second and third articular mechanisms being capable of vertically moving the side weir or delivery nozzle clamped to install/remove it onto/from the casting roll unit and the side-weir or delivery-nozzle preheating furnace, the second swivel mechanism being capable of swiveling the clamped side weir or delivery nozzle to displace it between the casting roll unit and the side-weir or delivery-nozzle preheating furnace.

4. The apparatus for displacing preheated members for a twin-roll caster according to claim 2, characterized in that each of said displacing robots comprises a clamp device with side-weir and delivery-nozzle clamps at its tip, at least three articulate mechanism with three arms and at least two swivel mechanisms, the first swivel mechanism being capable of switching object or objects to be clamped by rotating the clamp device in a vertical plane, the first articular mechanism being capable of keeping vertical the side weir or delivery nozzle clamped by the clamp device, the second and third articular mechanisms being capable of vertically moving the side weir or delivery nozzle clamped to install/remove it onto/from the casting roll unit and the side-weir or delivery-nozzle preheating furnace, the second swivel mechanism being capable of swiveling the clamped side weir or delivery nozzle to displace it between the casting roll unit and the side-weir or delivery-nozzle preheating furnace.

5. The apparatus for displacing preheated members for a twin-roll caster according to claim 3, characterized in that a water cooler is provided for each of said clamp devices and said arms.

6. The apparatus for displacing preheated members for a twin-roll caster according to claim 4, characterized in that a water cooler is provided for each of said clamp devices and said arms.

7. The apparatus for displacing preheated members for a twin-roll caster according to claim 3, characterized in that expandable and contractible heat insulators are provided for said clamp device, the respective swivel mechanisms and the respective articular mechanisms so as to prevent them from heat.

8. The apparatus for displacing preheated members for a twin-roll caster according to claim 4, characterized in that expandable and contractible heat insulators are provided for said clamp devices, the respective swivel mechanisms and the respective articular mechanisms so as to prevent them from heat.

9. The apparatus for displacing preheated members for a twin-roll caster according to claim 5, characterized in that expandable and contractible heat insulators are provided for said clamp device, the respective swivel mechanisms and the respective articular mechanisms so as to prevent them from heat.

10. An apparatus for displacing preheated members for a twin-roll caster according to claim 6, characterized in that expandable and contractible heat insulators are provided for said clamp devices, the respective swivel mechanisms and the respective articular mechanisms so as to prevent them from heat.

* * * * *